United States Patent [19]

Ayres

[11] 3,952,599

[45] Apr. 27, 1976

[54] FRACTIONAL-FILL CAPILLARY PIPETTE AND METHOD

[75] Inventor: Waldemar A. Ayres, Rutherford, N.J.

[73] Assignee: Becton, Dickinson and Company, East Rutherford, New Jersey

[22] Filed: May 18, 1972

[21] Appl. No.: 254,607

[52] U.S. Cl. ..... 73/425.4 P
[51] Int. Cl. ..... B01l 3/02
[58] Field of Search ..... 73/425.4 P, 425.6; 141/18, 31

[56] References Cited

UNITED STATES PATENTS

| | | | |
|---|---|---|---|
| 1,678,540 | 7/1928 | Trenner | 73/425.4 P |
| 2,685,800 | 8/1954 | Natelson | 73/425.4 P |
| 2,974,528 | 3/1961 | Sanz | 73/425.4 P |
| 3,045,494 | 7/1962 | Gerarde | 73/425.6 |
| 3,045,494 | 7/1962 | Gerarde | 73/425.6 |
| 3,285,296 | 11/1966 | Ishimaru | 73/425.6 |
| 3,500,689 | 3/1970 | Band | 73/425.4 P |

*Primary Examiner*—S. Clement Swisher
*Attorney, Agent, or Firm*—David S. Kane et al.

[57] ABSTRACT

A fractional-fill capillary pipette adapted to fill to a predetermined mark to obtain a desired known volume of liquid such as blood, plasma, test reagents or the like is disclosed. The bore of the capillary tube is provided with means to facilitate the filling of the capillary tube to the mark with a continuous column of liquid to obtain a predetermined known volume without the necessity of filling the entire capillary tube.

16 Claims, 9 Drawing Figures

FRACTIONAL-FILL CAPILLARY PIPETTE AND METHOD

BACKGROUND OF THE INVENTION

Assemblies employing micropipettes for delivering a precise known volume of fluid are in use, for example, Trenner pipette used to obtain an accurate blood sample to count blood cells. In practice, a rubber tube is fitted over the upper end of the pipette, one end of the rubber tube is held in the mouth and the lower end of the pipette is held in a drop of blood. The blood is sucked into the pipette to the mark, the end of the pipette is wiped off and if an excess amount of blood is in the pipette an absorbent material such as tissue paper is used to remove excess blood. A diluent is then drawn into the pipette to a second mark to dilute the blood sample. If there is an error in filling to either mark then the dilution is inaccurate which results in erroneous test results.

Another method employed is to fill a micropipette to a fill mark indicated thereon and hold the pipette substantially horizontally and intentionally overflow the pipette. Then an absorbent tissue is applied to the wet end of the pipette and by capillarity a portion of the liquid is removed from the pipette. However, the miniscus of the liquid column is hard to control in this fashion since overfill or underfill may easily occur.

Conventional micropipettes of the type having capillary bores to be filled to a mark are difficult to handle and to measure accurately precise volumes of a fluid, it requires considerable experience and dexterity by a technician and, in many cases, leads to error in determining the test results.

Another prior art method for accurately filling a capillary with a first liquid, such as blood, serum, plasma, or chemical solution or mixture, and then mixing it with a predetermined volume of a second liquid, such as a diluent, or reagent, or liquid mixture, is commercially available and is sold under the trade name UNOPETTE System and is described in U.S. Pat. Nos. 3,045,494, 3,433,712 and others. In these patents the capillary is a tube which automatically fills throughout its length and by controlling the bore diameter and tube length a predetermined volume of liquid fill is achieved with high accuracy.

Capillary tubes automatically fill due to several factors. The tube is made of a material, usually glass, which has high wettability characteristics relative to the liquid, such as blood, throughout its length. Very small bore diameters are used whereby the surface tension forces are large, tending to draw the liquid into the tube. Also, the meniscus formed at each end of the liquid column is fairly strong relative to the weight of the liquid column, so that the liquid-filled tube is comparatively immune to the flowing out at either end due to tipping or other handling, at least to a practical extent in normal careful use.

When using capillary tubes care is taken to be sure that neither liquid-filled end is touched to any nearby object, because a drop of blood might then be transferred to such object and the volumetric accuracy of the remaining blood would be lost and the test would be ruined.

There has been a standing need for additional kinds of tests to utilize the UNOPETTE System for chemical and blood tests where the original sample, the first liquid, should be much larger in volume than heretofore — as much as 100 percent larger, even 200 percent or 300 percent or more. It is impractical to merely increase the length of the glass capillary by such large amounts because they would be so fragile and so frequently broken as to be prohibitive. The bore size needs to be radically increased. However, with each increment of increase in bore size, the capillary forces decrease, and more than proportionally. Also the forces at the meniscus at each end rapidly diminish while the weight of the liquid column increases more than proportionally relative to the bore diameter. These factors combine to make a filled capillary of substantially increased bore size so extremely sensitive to tipping (so that liquid runs out the lower end) that it is impractical.

SUMMARY OF THE INVENTION

This invention solves the above described problems of the prior art by combining:

1. Filling the capillary pipette automatically by utilizing surface tension forces; not by sucking;
2. Filling partially, to a predetermined volume at a mark, the fill automatically stopping at this point;
3. Pneumatically sealing the unfilled end of the tube without touching the liquid column, in order to immobilize the filled tube from loss of the liquid sample due to tipping and running out the lower end, and
4. Mixing the liquid sample with a second liquid in an accurate predetermined volumetric ratio.

It is an object of the invention to provide a capillary tube which will automatically fill to a predetermined point or mark so that a precise known volume of fluid will be measured. Also, the precise volume will be available for dilution in a premeasured volume of diluent to obtain a precise known ratio of solution so that a test can accurately be performed.

It is an object of the present invention to provide a capillary tube in which a portion of the bore has different wettability characteristics at its adjacent portion so that when fluid is taken up into the capillary bore the fluid will form a continuous fluid column only in that portion of the capillary bore having the same wettability characteristics as the fluid. It is also an object of the present invention to pre-treat the capillary bore so that liquid entering the capillary bore will be controllably filled to the pre-treatment zone or mark.

My invention generally contemplates providing a capillary tube having a bore with non-uniform wettability characteristics relative to the liquid to be quantitated. The non-uniform wettability characteristics of the bore are provided in at least two adjacent zones of the capillary tube. The first zone having good wettability characteristics in relation to the liquid to be quantitated is provided with a bore length and cross-section of desired predetermined volumetric capacity. The first zone is filled with the liquid by capillarity to a mark which defines the interface between the first and second zones. The second zone of the capillary bore has lower wettability characteristics relative to the liquid to be quantitated providing resistance to filling thereof by capillarity. Also, the invention contemplates an analytical device including a capillary pipette having means for fractionally filling the bore with a liquid to a predetermined volume which is less than the total volumetric capacity of the micropipette, then mixing the volume of liquid with a predetermined known volume of diluent to obtain a volumetric ratio of a mixture of sample and diluent.

BRIEF DESCRIPTION OF THE DRAWINGS

FIG. 6 also illustrates a resilient container in which the capillary assemblies of FIGS. 6, 7 and 8 may be employed for carrying out a test with a known volume of diluent.

DESCRIPTION OF THE PREFERRED EMBODIMENTS

Figure 1:
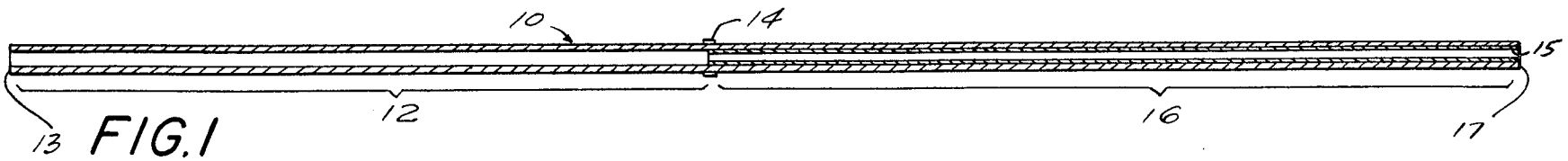
FIG. 1 is an elevational view of a capillary tube in section in which a first zone having good wettability characteristics is depicted as the uncoated zone and a second zone having a lower wettability characteristic relative to the liquid to be continued therein. A mark dividing the zones is placed between the ends which indicates the interface between the two zones where the liquid will automatically stop when filling the capillary bore.
Figure 2:
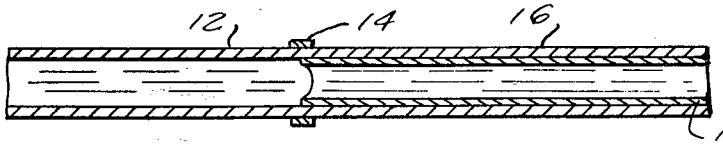
FIG. 2 is a fragmentary sectional view of the capillary tube greatly enlarged which illustrates the form of the minisucs of a liquid which does not wet the sides of the capillary bore at the interface where the liquid stops at the fill mark.
Figure 3:
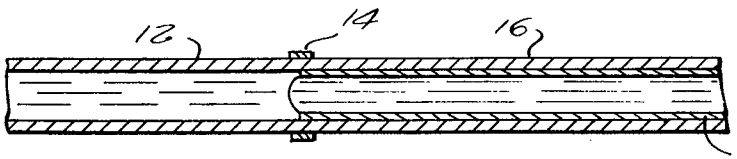
FIG. 3 is an enlarged fragmentary sectional view of a capillary tube similar to FIG. 2 which illustrates a different liquid than the liquid of FIG. 2 in that the liquid of FIG. 3 wets the capillary bore and ceases filling the capillary at the mark defining the interface between the zones.
Figure 6:
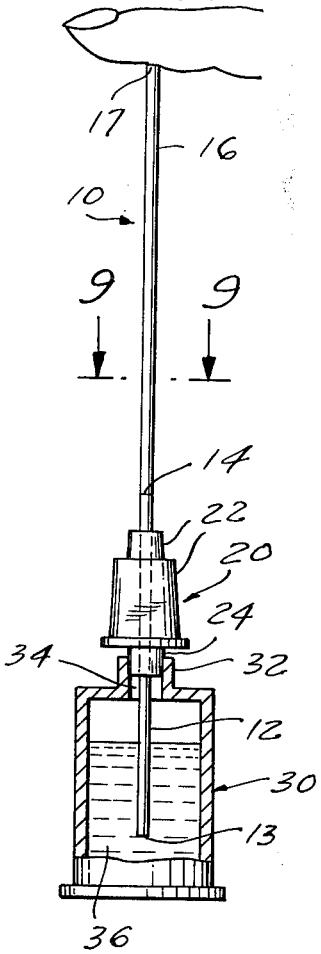
FIGS. 6 through 8 illustrate various sizes of capillary tubes with differing volumetric capacities.
Figure 9:
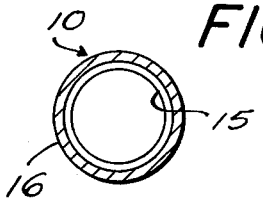
FIG. 9 is a sectional view taken along the lines 9—9 of FIG. 6 of the capillary tube.

A fractional-fill capillary device is illustrated in FIG. 1 and is referred to generally as numeral 10. The capillary tube 10 consists of a first zone 12 which extends from end 13 of capillary tube 10 to the fill mark 14 so that a predetermined known volume of liquid will be contained in zone 12 of capillary tube 10. A second zone 16 which extends from the other end 17 of capillary 10 to the fill mark 14 may be coated with a material which has differing or non-uniform wettable characteristics than the bore of the capillary 10 defined by zone 12. For example, the bore of capillary 10 of zone 16 as seen in FIG. 9 may be coated with various hydrophobic materials 15 such as paraffin wax, beeswax or any other known hydrophobic materials which will adhere to the capillary bore surface and render the bore surface non-wettable. Other hydrophobic materials may be used such as various plastics made into dilute lacquers by dissolving them in their respective solvents then applying the lacquer as a coating on the internal surface of the tube up to the desired mark. Such plastics might include ethyl cellulose, cellulose acetate, methyl methacrylate, polycarbonate, polystyrene, etc. filled to the mark 14 as depicted in FIG. 1. A holder 20 is slidably mounted on capillary 10 to facilitate holding the capillary when filling it to mark 14 and when dispensing the liquid contained therein as illustrated in FIG. 6. Holder 20 is formed preferably of a plastic material such as polyethylene and is provided with a pair of flat surfaces 22 which serve as gripping means to hold the capillary between the thumb and forefinger. The holder is positioned between ends 13 and 17 of capillary 10 so that fill mark 14 lies beyond the holder 20 to enable the technician to observe directly the blood column at fill mark 14 of capillary 10. Thus, the technician is assured of obtaining accurate volumes of sample before diluting the same as illustrated in FIG. 6.

Figure 4:
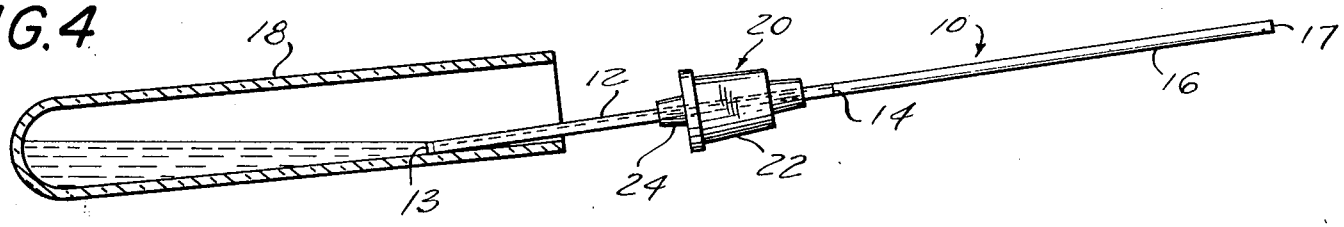
FIG. 4 illustrates a means for filling the capillary tube by immersing one end thereof into a liquid.
Figure 5:
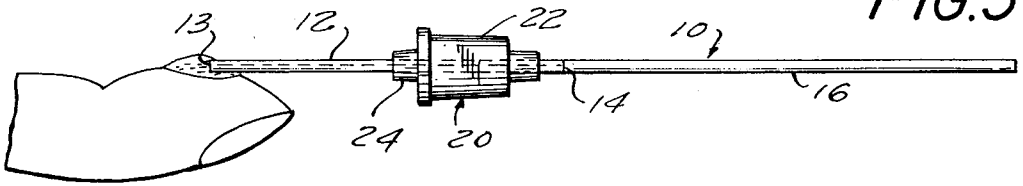
FIG. 5 illustrates another means for filling a capillary tube by immersing one end thereof into a drop of blood taken in finger puncture.

FIG. 5 is similar to FIG. 4 in that a partial fill capillary assembly 10 fitted with a holder 20 is illustrated being filled with blood from a finger puncture. End 13 of capillary 10 is immersed in a drop of blood formed on the finger. The blood fills the capillary bore of zone 12 forming a continuous column which automatically ceases filling at mark 14 which defines the interface between zone 12, i.e. the hydrophilic or water zone and hydrophobic zone 16.

In FIG. 6, as indicated above, the partial fill capillary assembly 10 is illustrated in which a known volume of liquid such as blood partially fills capillary 10 to mark 14. The blood sample of predetermined known volume is dispensed in reservoir 30 containing a premeasured volume of liquid diluent so that the test sample of blood and liquid diluent form a predetermined known ratio of blood to diluent. Container 30 is preferably formed of a resilient material such as polyethylene and is closed at one end and open at the other end, terminating in a neck portion 32 having a passage opening 34 which is adapted to receive holder 20 in sealing engagement. In practice, when capillary 10 is filled with a liquid sample such as blood, and prior to dispensing the sample into reservoir 30, the reservoir is slightly compressed so that capillary 10 when mounted in sealing engagement in passage 34 of neck portion 32, the liquid sample will be withdrawn from capillary 10 by simply releasing the compressive force exerted on container 30. Then, by repeatedly applying a slight squeezing action on container 30 the capillary bore defined by zone 12 can be rinsed with the diluent 30 so that an accurate predetermined sample mixture is obtained having a known ratio.

Figure 7:
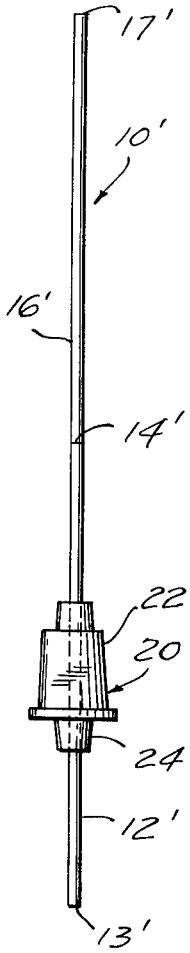
Figure 8:
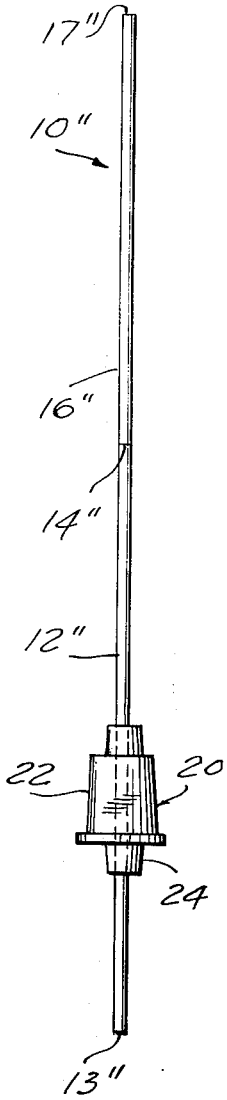

FIGS. 7 and 8 illustrate capillaries 10′ and 10″ in which the mark 14 defining the interface between the hydro philic and hydrophobic zones is illustrated being further disposed from end 13′. Thus, partial fill capillaries can be provided having greater volumes. Also, containers similar to container 30 may be employed and may vary in the proportion of diluent so that a predetermined known ratio between sample and diluent can be obtained.

In practicing the invention herein capillary tube 10 may be coated with a hydrophobic material 15 such as wax, beeswax or a lacquer containing a suitable plastic or the like to form zone 16 of capillary tube 10. The capillary bore thus treated has non-uniform wettability characteristics with respect to the untreated portion defined by zone 12. This can be accomplished by preparing a solution of microcrystalline paraffin wax or beeswax having a melting point of about 150° to 175°F. which is dissolved in a suitable solvent such as carbon tetrachloride, n-hexane or the like. A porous container such as a wire rack of a fine mesh is employed to hold the untreated capillary tubes in an upright position. Then, by lowering the rack into the solution of microcrystalline wax and accurately adjusting the depth in which the capillaries are immersed into the paraffin wax solution, the wax solution will fill the capillary bore to the fill mark 14. When the wax solution has reached fill mark 14 the rack is removed and excess solution allowed to drip from the rack. The capillaries are removed from the fine wire mesh rack and allowed to dry by any convenient means such as drying at room temperature or by placing the treated capillary in a warm but not hot oven or drying by vacuum. After the solvent is removed from the treated portion of the capillary bore a thin film of wax remains on the interior bore surface which will form a capillary having two zones adjacent to each other of differing wettability characteristics.

After the capillary has been dried holders such as those described in FIGS. 4 through 8 are slidably mounted on the capillary with a relatively tight interference fit. The plastic holder is moved longitudinally to its desired position, as shown in FIGS. 4 through 8. Thereafter the holder will be held on the capillary by friction.

Resilient containers such as those made from polyethylene are filled with a known volume of diluent for performing tests. For example, where blood is to be tested such as shown in FIG. 5, the diluent may be a solution suitable for performing any one of various clinical tests of blood or of other biological fluid. The capillary tube is filled with a fluid, i.e. blood, by holding the capillary tube in a substantially horizontal position as shown. Blood will fill the capillary bore in zone 12 and will automatically stop filling when it reaches the interface between zones 12 and 16 which is marked on the capillary by a black line 14. To facilitate cleaning excess blood from end 13 of capillary tube 10 a finger is placed over end 17 of capillary tube 10 to immobilize the blood column in zone 12, then the tip 13 can be carefully wiped to remove extraneous portions of blood from the outside of the capillary. Still holding the finger over the end 17 to immobilize the blood column in zone 14, the filled capillary is mounted on container 30 as shown in FIG. 6. Before capillary 10 is mounted in sealing position on container 30, container 30 is compressed. Then capillary 10 is sealed on the container as shown in FIG. 6 and the finger over end 17 is removed. Then the finger pressure or compressive force is released from container 30 thus allowing blood sample contained in zone 12 to be sucked into the diluent of container 30. To ensure that all of the blood sample is removed from the bore of the capillary, all that is required is to repeat the compressive force on the container and release it several times. The mixture of diluent and blood will rise in the capillary bore past mark 14 so that a rinsing action takes place. The resulting mixture is a predetermined volumetric ratio. After the rinsing is completed, a sample which is completely and homogeneously mixed can be removed from container 30 by capillary 10 or other convenient means to perform the desired clinical test of the biological fluid.

It is obvious that many modifications may be made without detracting from the inventive concept described herein.

I claim:

1. A fractional-fill pipette for the quantitation of a liquid comprising;

a. a capillary tube having a bore with non-uniform wettability characteristics relative to the liquid to be quantitated, the non-uniform wettability characteristics being provided in at least two adjacent zones; and b. said two adjacent zones including a first zone having substantial wettability characteristics in relation to said liquid throughout a bore length and cross-section providing a desired predetermined volumetric capacity when said first zone is filled with said liquid by capillarity, and a second zone of said bore having lower wettability characteristics relative to said liquid so that a resistance to filling of the second zone by capillarity is obtained.

2. The fractional-fill pipette of claim 1 wherein said capillary tube has a mark to define the juncture of the interface of said first zone and said second zone to facilitate visibly checking the accuracy with which the capillary bore is filled with liquid.

3. The fractional-fill pipette of claim 1 wherein the capillary tube is formed of glass.

4. The fractional-fill pipette of claim 1 wherein the bore surface of the second zone is a coating of hydrophobic material.

5. The fractional-fill pipette of claim 1 wherein the bore surface of the second zone is a coating of paraffin wax.

6. The fractional-fill pipette of claim 1 wherein the surface of the bore of the second zone is a coating of beeswax.

7. The fractional-fill pipette of claim 1 wherein a holder is mounted between the ends of the capillary tube with a coupling means on the holder adapted to receive a flexible container in sealing engagement therewith.

8. A fractional-fill pipette assembly for the quantitation of a liquid comprising a capillary tube having a bore extending therethrough, means disposed in the bore and located between the ends of the capillary tube to provide adjacent zones having non-uniform wettability characteristics relative to the liquid to be quantitated, said means defining an interface between a first zone having good wettability characteristics in relation to the liquid to be collected, said first zone having a bore length and cross-section providing the desired predetermined volumetric capacity when the first zone is filled with the liquid by capillarity and the second zone having lower wettability characteristics relative to said liquid so as to provide resistance to filling of the second zone by capillarity, a holder mounted between the ends of the capillary tube and having coupling means adapted to receive a flexible container in sealing engagement so that a liquid sample can be dispensed from the first zone of the capillary tube into a premeasured diluent in said flexible container to obtain a predetermined volumetric ratio.

9. The fractional-fill pipette of claim 8 wherein the capillary tube is formed of glass.

10. The fractional-fill pipette of claim 8 wherein the bore surface of the second zone is a coating of hydrophobic material.

11. The fractional-fill pipette of claim 8 wherein the bore surface of the second zone is a coating of paraffin wax.

12. The fractional-fill pipette of claim 8 wherein the surface of the bore of the second zone is a coating of beeswax.

13. In clinical analytical work including combining a plurality of liquids in a predetermined ratio, the method comprising the steps of:

a. fractionally filling by capillarity a pipette having a bore with non-uniform wettability characteristics in at least two adjacent zones so that a first liquid fills the pipette to a predetermined volume which is less than the total volumetric capacity of the pipette;
b. immobilizing the liquid column of said first liquid contained within the pipette by hermetically closing the end of the pipette not containing liquid;
c. removing any excess liquid on the outside of the pipette;
d. inserting the pipette into a reservoir containing a predetermined volume of a second liquid;
e. hermetically sealing said pipette to said reservoir;
f. transferring said first liquid from said pipette to said reservoir; and
g. thoroughly rinsing said pipette and mixing said first and second liquids to provide the mixed liquids in the desired predetermined volumetric ratio.

14. In chemical and analytical work including combining a plurality of liquids in a predetermined ratio, the method comprises the steps of:

a. fractionally filling by capillarity a pipette having a bore with non-uniform wettability characteristics in at least two adjacent zones so that a first liquid fills the pipette to a predetermined volume which is less than the total volumetric capacity of the pipette;
b. immobilizing the liquid column of said first liquid contained within the pipette by hermetically closing the end of the pipette not containing liquid;
c. removing any excess liquid on the outside of the pipette;
d. inserting the liquid-filled end of the pipette into a resilient reservoir containing a predetermined volume of a second liquid;
e. hermetically sealing said pipette to said reservoir;
f. transferring said first liquid from said pipette to said second liquid in said reservoir by suction; and
g. thoroughly rinsing said pipette and thoroughly mixing said first and second liquids by repeatedly squeezing and releasing said resilient reservoir to provide the desired mixture of said first and second liquids having the desired predetermined volumetric ratio.

15. In combining a plurality of liquids in a predetermined volumetric ratio the method comprising the steps of:

a. fractionally-filling a first container having two portions, a first portion having an interior surface with substantial wettability relative to a first liquid, and said container having a second portion having an interior surface with substantially less wettability relative to said first liquid, whereby the first liquid readily flows into and fills said first portion but automatically stops at the end of said first portion and does not enter into said second portion, so that said first container is automatically fractionally-filled to a predetermined volumetric capacity;
b. immobilizing the liquid column of said first liquid contained within the first container by hermetically closing the unfilled portion of the first container;
c. removing any excess liquid on the outside of said first container;
d. inserting the liquid filled portion of said first container into a resilient second container having therein a predetermined volume of a second liquid;
e. hermetically sealing said first container relative to said second container;
f. transferring said first liquid from said first container to said second liquid in said second container by suction;
g. thoroughly rinsing said first container and thoroughly mixing said first and said second liquids by repeatedly squeezing and releasing said resilient second container to provide the mixture of liquids having the desired predetermined volumetric ratio.

16. As an article of manufacture, a container for a liquid, said container having two unlike interior surfaces including a first portion with a surface readily wettable by said liquid, whereby said container is adapted for filling by said liquid to the limit of the wettable surface and automatically stops filling when the liquid reaches a second portion of the container having an interior surface substantially less wettable by said liquid.

* * * * *